United States Patent [19]

Graef et al.

[11] Patent Number: 4,544,149

[45] Date of Patent: Oct. 1, 1985

[54] MULTI-PICKER MECHANISM FOR AUTOMATIC BANKING MACHINES

[75] Inventors: Harry T. Graef, Massillon; Jeffrey A. Hill, Canton; Scott A. Mercer, Hanoverton; Kevin H. Newton, North Canton; Gerald T. Sedlock, Hartville; Mark J. Wise, North Canton, all of Ohio

[73] Assignee: Diebold, Incorporated, Canton, Ohio

[21] Appl. No.: 345,577

[22] Filed: Feb. 4, 1982

[51] Int. Cl.[4] ..... B65H 3/08

[52] U.S. Cl. ..... 271/107; 271/111; 271/146

[58] Field of Search ..... 271/21, 22, 91, 100, 271/101, 106, 107, 110, 111, 262, 265, 146

[56] References Cited

U.S. PATENT DOCUMENTS 3,583,696 6/1971 Runzi ..... 271/110 X 4,357,007 11/1982 Franciscus ..... 271/111 X

FOREIGN PATENT DOCUMENTS 1525698 9/1978 United Kingdom .

*Primary Examiner*—Richard A. Schacher

*Attorney, Agent, or Firm*—Frease & Bishop

[57] ABSTRACT

A note picker mechanism for picking new and circulated paper money bills from stacks thereof through access openings of sealed, tamper-indicating containers for the notes when installed in ATM's. The mechanism has a primary suction picker device and a secondary friction-engaging picker device. The friction-engaging picker is switchably engaged with or disengaged from the suction picker so that if a picking failure occurs, the picker mechanism is automatically changed from joint operation of the primary and secondary picker to operation of the primary picker alone, or vice versa, to correct the cause of the picking failure.

40 Claims, 26 Drawing Figures

FIG. 2

FIG. 7A

FIG. 7B

SIMPLIFIED OLD SYSTEM BILL FLOWCHART SWITCHABLE THUMPER

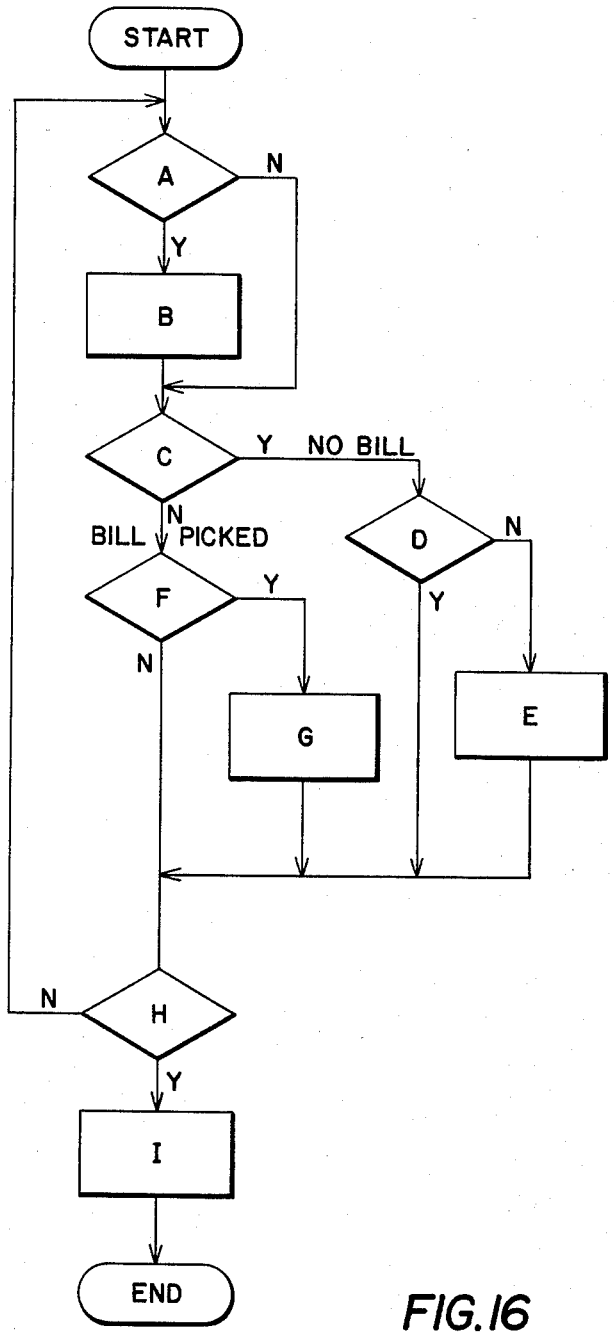

A) IS THE SOLENOID OFF?

B) PULL SOLENOID, ACTIVATE FEED

C) DOCUMENT NOT FED?

D) IS THE THUMPER ALREADY ON?

E) DROP SOLENOID AT TIME AND TURN ON THUMPER

F) HAS THE THUMPER BEEN TURNED ON?

G) DROP SOLENOID AT TIME AND TURN OFF THUMPER

H) HAS THE DESIRED NUMBER OF DOCUMENTS BEEN FED?

I) DROP SOLENOID AT TIME AND STOP FEEDING

FIG. 16

MULTI-PICKER MECHANISM FOR AUTOMATIC BANKING MACHINES

CROSS-REFERENCE TO RELATED PATENT APPLICATIONS

The new multi-picker mechanism is an improvement upon the device disclosed in copending U.S. Graef et al. application Ser. No. 194,338, filed Oct. 6, 1980, now U.S. Pat. No. 4355,797 of Oct. 26, 1982 for Picker Mechanism for Automatic Banking Machines, and may utilize portions of a system for determining bill status in an automatic paper money dispensing system disclosed in copending U.S. Graef et al. application Ser. No. 309,022, filed Oct. 5, 1981, to control operation of the multi-picker mechanism, now U.S. Pat. No. 4,462,587, which in turn is an improvement on the detector mechanism described in Butcheck et al U.S. Pat. No. 4,154,437, all being owned by the Assignee of this application.

BACKGROUND OF THE INVENTION

1. Field of the Invention

The invention relates to automatic banking or teller machines (ATM's) and particularly to ATM's which may be installed in free-standing locations either remote from central banks or at locations accessible to customers in or adjacent central banks for dispensing paper money notes of one or more denominations.

More particularly the invention relates to a picker mechanism, having primary and secondary picker devices, herein sometimes called "multi-picker components", which avoids, overcomes and eliminates problems that have been encountered, in the operation of a picker mechanism having only a primary picker device, for example when picking paper money notes from a stack of notes composed entirely of new paper money, and also for example for picking paper money notes from a stack composed of circulated paper money having a random arrangement of notes of varying degrees of age, wear, stiffness or other physical characteristics.

Further, the invention relates to a new picker mechanism having primary and secondary picker devices, components or elements which in a first operative mode act in unison to pick paper money notes one at a time, from a supply stack of such notes confined in a security container, through a container access opening; and which mechanism in a second operative mode normally utilizes the primary picker component only to pick notes from a supply stack confined in such a security container through a container access opening, until a picking failure occurs, whereupon the picker mechanism is automatically converted or switched to the first operative mode utilizing the primary and secondary picking devices acting in unison to reestablish normal picking operation.

In addition, the invention relates to a multi-picker mechanism which normally operates in the first described mode when picking paper money notes from a stack of new paper money, and which normally operates in the second mode when picking paper money from a stack of circulated paper money notes having a random arrangement of notes having differing physical characteristics.

Also, the invention relates to a multi-picker mechanism having primary and secondary picker devices, elements or components that are switchable selectively between said first mode with engaged primary and secondary picker devices acting in unison to pick notes, and said second mode with disengaged primary and secondary picker devices with only the primary picker device acting to pick notes, wherein the switchable selectivity is under intelligent control to switch the engaged status of the primary and secondary picker device from the first to second mode of operation, or vice versa, when continued operation in one mode results in picking failure.

Finally, the invention relates to a multi-picker mechanism having two modes of operation, switchable one to the other, which is operatively connected with a confined stack of paper money notes in a predetermined selected mode of operation in accordance with the characteristics of the confined stack of paper money notes to be picked.

2. Description of the Prior Art

The picker mechanism of said application Ser. No. 194,338 is the only prior art known to applicants which picks and withdraws paper money notes from a security note container through a rectangular container access opening smaller in at least one direction than the dimensions of the note being picked.

However, it has been discovered in operation and use of said prior picker mechanism disclosed in said application Ser. No. 194,338 that where the supply stack of paper money is composed entirely of newly issued paper money from which a note is picked one at a time through a rectangular access opening of the aforesaid size in a security note container in which the stack is confined under some pressure, it is frequently impossible for the suction cup picker head of the picker mechanism to dislodge, separate or peel from the supply stack the note exposed at the access opening from the next adjacent note in the stack. This results in picking failure.

Further, it has been discovered that sometimes, when said prior picker mechanism disclosed in said application Serial No. 194,338 is used to pick notes from a stack of circulated notes, and notes, for example, having very limp characteristics are encountered, the limp notes tend to crumple or bunch up, and frequently it is impossible for the suction cup to establish effective suction cup engagement with the limp note. This condition also results in a picking failure.

Thus a need exists in the art for an improved picker mechanism which can reestablish normal picking operations of paper money notes confined in a security container as aforesaid, when the described types of picking failures, occur, and which improved picker mechanism is intelligently controlled to recognize the picking failure encountered and to adjust or switch picker mechanism operation from one mode to another to eliminate the picking failure recognized.

From another standpoint, since picking failures frequently occur when picking notes one at a time from a stack of new paper money notes in a security container, it is desirable normally to operate the new multi-picker mechanism in the first mode all of the time with the primary and secondary picker devices engaged or locked together and acting in unison so as to avoid a picking failure whenever notes are encountered during picking that tend to stick together. Further, when the multi-picker mechanism in the first mode, with primary and secondary picker devices engaged and acting in unison, is picking notes from a stack of new paper money notes and is involved in a picking failure, it has been discovered that disengaging the primary and secondary picker devices so that the mechanism operates in said second mode using the primary picker device only, will correct the picking failure and normal picking will continue.

Accordingly, it is desirable, when a sealed container with a supply stack of new paper money notes is being installed in an ATM, to selectively predetermine the status of the mode of operation of the multi-picker mechanism so that the mechanism is set in its first operational mode when the installation in an ATM of a container having a stack of new paper money notes therein is completed.

Still another condition can arise where picking failures occur when picking notes one at a time from a stack of circulated notes with a random arrangement of notes in varying conditions of age, wear and stiffness or limpness located in a stack in a security container. Normally it is desirable not to operate the new multi-picker mechanism in the first mode, but picking operations of circulated notes should be carried out in the second operative mode wherein the secondary picker device is disengaged and not active, and picking is carried out by the primary suction cup picker device.

However, when picking of circulated notes is carried out in the manner described immediately above, and a picking failure occurs, operation of the multi-picker mechanism must be switched to the first operative mode which we have discovered is effective to correct a picking failure when picking circulated notes. Such picking failure normally results from a very limp note bunching or crumpling up during picking so that suction engagement of the crumpled note by the primary suction cup picker device is not effective. When operation is switched to the first mode, the secondary picker device assists the primary picker device in reestablishing normal picking.

After normal picking operation of circulated notes has been reestablished, the operative mode of the multi-picker mechanism is switched back to the second mode of operation and normally so maintained until another picking failure is encountered.

Accordingly it is desirable, when a sealed container with a supply stack of circulated paper money notes with random arrangement of notes of variable age and wear characteristics is being installed in an ATM, to selectively predetermine the status of the mode of operation of the multi-picker mechanism so that the mechanism is set in its second operational mode when the installation in an ATM of a container having a stack of circulated paper money notes therein is completed.

Thus, in addition to the existing need described above, there is a need in the art for a picker mechanism that may be operated to avoid or correct the various types of picking failures that can occur, and which easily may be coordinated with various sealed containers having different kinds of paper money notes therein when such containers are installed in an ATM.

SUMMARY OF THE INVENTION

Objectives of the invention include providing a multipicker mechanism for picking notes to be dispensed by an ATM from supply stacks of notes which stacks may be composed of note types differing in characteristics one stack from another such as new notes in one stack and circulated notes in another, wherein the mechanism is composed of a primary and a secondary picker device differing one from another in type of picking engagement, and wherein the picker mechanism may have selective first and second modes of operation switchable one to the other, and vice versa, to restore normal picking when a picking failure occurs; providing such new multi-picking mechanism which operates automatically to restore normal picking when picking failures occur of types that have been encountered in the operation of prior picking mechanisms, for example, a type of picking failure encountered when picking from a stack of new paper money notes, and a different type of picking failure encountered when picking from a stack of circulated notes; providing such new multi-picking mechanism in which the primary and secondary picking devices are engageable or disengageable and may be switched between a first mode of operation wherein the primary and secondary devices are engaged and act in unison, and a second mode of operation wherein the primary and secondary picking devices are disengaged and only the primary picking device is operative to carry out picking; providing such new multi-picker mechanism in which switching may occur between engaged and disengaged operation, or vice versa, depending upon the type of notes being picked when picking failure occurs; providing such new multi-picker mechanism which is preset normally to operate in said first mode when a stack of new paper money notes is associated with the mechanism during installation of such stack in an ATM to be picked thereby, and which is present normally to operate in said second mode when a stack of circulated paper money notes is associated therewith during installation of such pack in an ATM to be picked thereby; and providing a new multi-picker mechanism and modes of operation thereof, which achieve the stated objectives and correct difficulties encountered in the use of prior picker mechanisms in a reliable and effective manner, and which solves problems that have been encountered and satisfies a need that has emerged in the operation and use of prior picker mechanism for ATM's.

These and other objectives and advantages may be obtained by the construction stated in general terms as a multipicker mechanism for picking notes one at a time, from supply stacks of various types of notes located in sealed, tamperindicating note containers housed in an ATM, through container access openings when uncovered, including, a primary picker member having a vacuum type picker cup, and a secondary picker member having a roll rotatable in one direction only which frictionally engages a note; means for selectively engaging the primary and secondary members in unison, or disengaging the secondary member from the primary member so that the primary member acts alone to pick notes; means for moving said picker members in various directions with respect to the note surface of a note being picked to grip the note surface, to distort its shape, and to dislodge, separate and pull such note from the stack of notes of which it formed a part; and means for controlling the operation of said multi-picker mechanism to switch the mechanism from one of two operative modes to the other, and vice versa, depending upon the type of notes being picked, when a picking failure occurs.

BRIEF DESCRIPTION OF THE DRAWINGS

A preferred embodiment of the invention-illustrative of the best mode in which applicants have contemplated applying the principles-is set forth in the following description and shown in the drawings and is particularly and distinctly pointed out and set forth in the appended claims.

FIG. 2 is an enlarged sectional view taken on the line 2—2, FIG. 1, illustrating, mostly in full lines but with certain parts broken away, various components of the multi-picker mechanism;

FIG. 7A is a perspective view of a latch plate, locating the latch plate generally in the same manner as shown in FIG. 7;

FIG. 7B is another perspective view of the latch plate looking at the back side thereof as related in FIG. 7A which shows the front side of the latch plate;

FIG. 8-1, FIG. 8A-1 and FIG. 8B-1 are enlarged diagrammatic views of certain of the parts shown in FIGS. 8, 8A and 8B, respectively;

FIG. 16 is a system flow chart describing the general operation of the switchable secondary picker component of the multi-picker mechanism of the invention.

Similar numerals refer to similar parts throughout the various figures of the drawings.

DESCRIPTION OF THE PREFERRED EMBODIMENT

Figure 1:
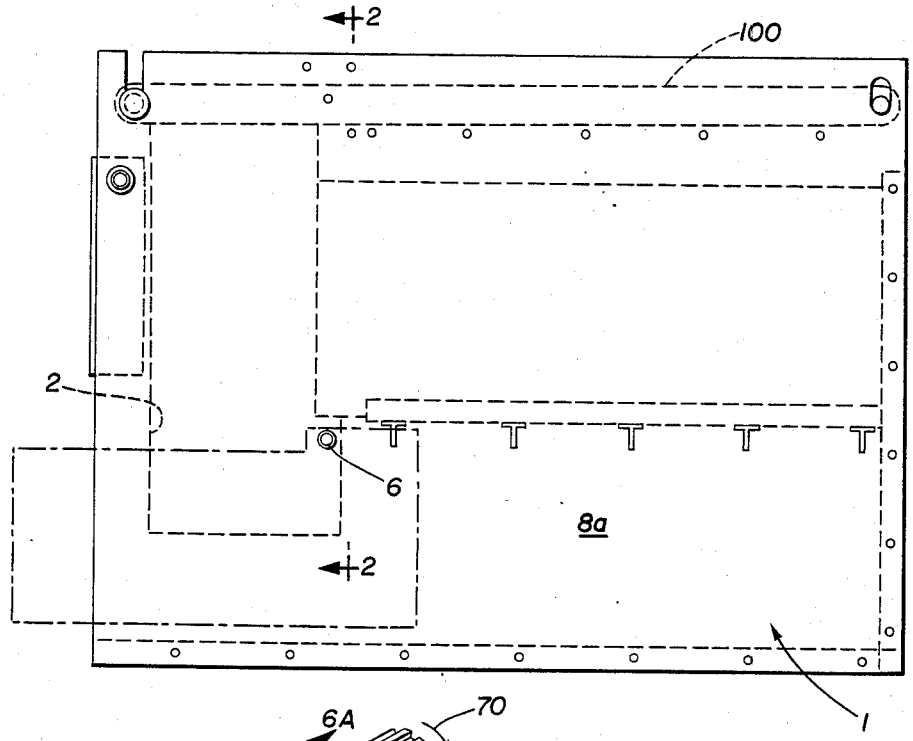
FIG. 1 is a somewhat diagrammatic side view of an ATM equipped with the improved multi-picker mechanism.

A typical cash dispenser unit for an ATM is diagrammatically illustrated at 1 in FIG. 1 of the general type shown in U.S. Pat. No. 4,154,437 loaded with two sealed, tamper-indicating note containers in the ATM housing generally of the type shown in U.S. Pat. No. 4,113,140. The unit 1 has the improved multi-picker mechanism of the invention mounted therein for withdrawing notes from the note containers and delivering such notes to the transport mechanism of the unit 1. Details of the new picker mechanism and its construction, operation and control are shown in the remaining figures of the drawings.

The new picker mechanism of the invention includes components mounted in a picker housing 2 having side walls 3 and 4 and a closure wall 5. The housing 2 is pivotally mounted on a pivot shaft 6 the ends of the shaft being mounted at 7 and 7*a* on spaced frame members 8 and 8*a* of the dispenser unit 1.

The new multi-picker mechanism generally has a construction from a component standpoint the same as that disclosed in copending application Ser. No. 194,338 modified by combining therewith a new secondary picker member which may be engaged with or disengaged from the suction cup picker member of said application Ser. No. 194,338, which suction cup member thus becomes the primary picker member of the new multi-picker mechanism. Accordingly, said application Ser. No. 194,338 is incorporated herein by reference.

A drive motor 9 for the picker mechanism is mounted on the housing 2 which has driving connection through gearing generally indicated at 10 with a cam shaft 11 journaled at 12 on the picker housing side walls 3 and 4.

Picker member components are provided for each note container, two of which have been indicated as being present in the unit 1. Only the components of one picker mechanism are described below since the set of components for one container is duplicated and operated by the same drive mechanism when notes are being dispensed from both containers. The picker mechanism at the right hand of FIG. 2 is described, the left-hand picker mechanism being composed of left-hand counterparts of those in the right-hand mechanism.

Figure 3:
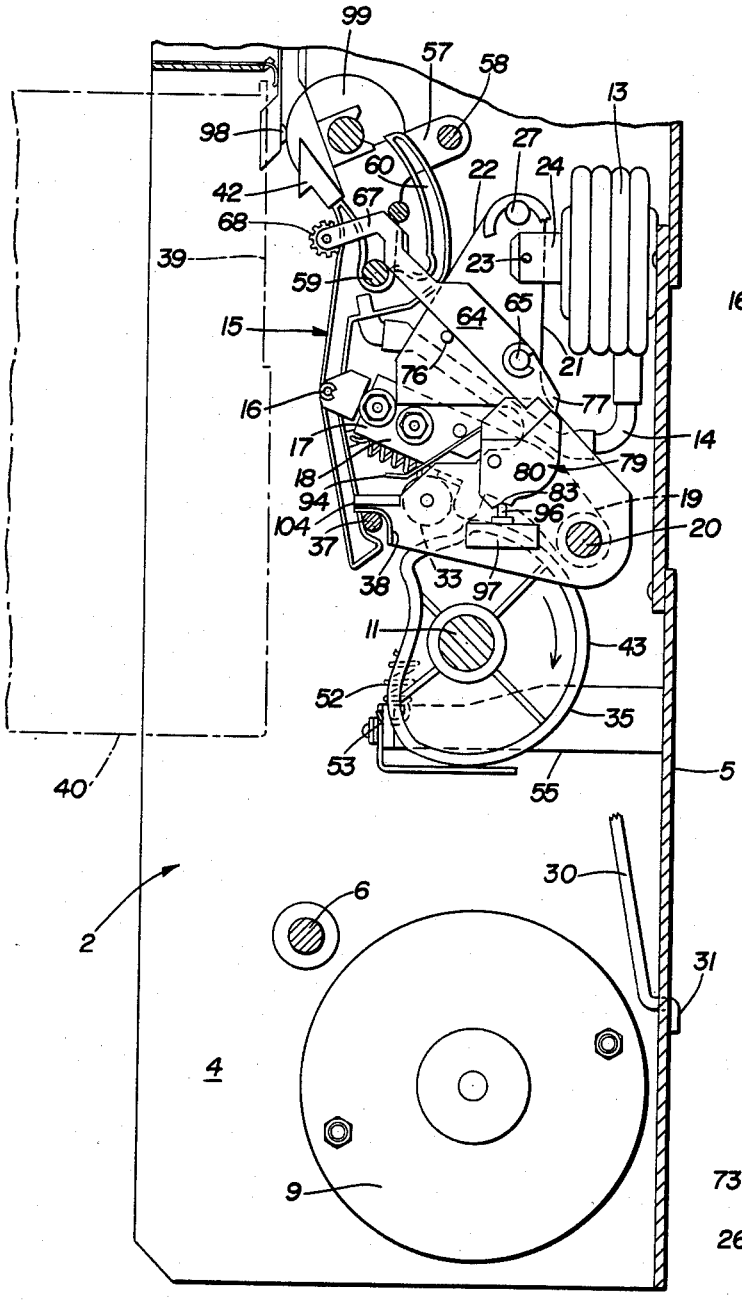
FIG. 3 is a sectional view taken on the line 3—3, FIG. 2, showing the parts in the positions when a picking operation has just been initiated.
Figure 3A:
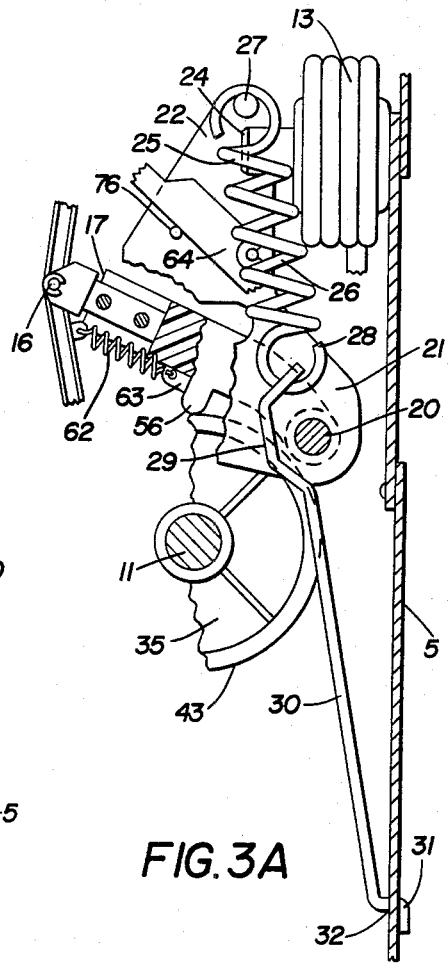
FIG. 3A is a view similar to portions of FIG. 3 with parts in the same position but some broken away and in section to illustrate constructional details not visible in FIG. 3.
Figure 3B:
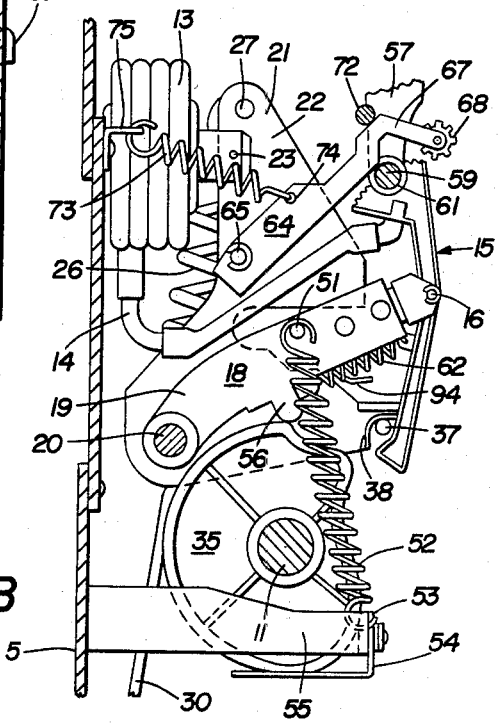
FIG. 3B is a view of the parts in FIG. 3 in the same position as in FIG. 3, looking in the direction of the arrows 3B—3B, FIG. 2.

Picker mechanism components for any note container include (FIGS. 2 and 3) a bellows 13 which is mounted on the housing wall 5. The interior of the bellows is connected by a tube 14, preferably flexible, with the interior of a hollow suction cup picker member 15 which is pivotally mounted intermediate its ends at 16 on one end 17 of lever 18, which lever 18 in turn is pivoted at its other end 19 on fixed bellows plate shaft 20 (FIGS. 3 and 3B).

A bellows plate 21 also is pivotally mounted on the bellows plate shaft 20 and one corner 22 of the bellows plate 21 is pivotally connected at 23 with a connector member 24 projecting from the bellows 13. The upper end 25 of a tension spring 26 is connected with a pin 27 mounted on the corner 22 of bellows plate 21 and is connected at its lower end 28 to the upper end 29 of strip member 30 whose lower end 31 is interengaged with the closure wall through a slot 32 in the closure wall 5 of picker housing 2 (FIGS. 2 and 3).

Bellows plate 21 has a control boss 33 projecting laterally therefrom at a triangular location remote from the bellows plate pivot shaft 20 and the bellows pivot connection 23. A cam follower roller 34 is journaled on a projecting end portion of boss 33 and normally engages picker control cam 35 fixed to and rotated by cam shaft 11 in a clockwise direction viewing FIG. 3. Bellows plate 21, unless restrained by means to be described, normally is urged to rotate in a counterclockwise direction, on bellows plate shaft 20, by spring 26 which exerts a strong pull on the bellows plate. Motion of the bellows plate 21 expands and collapses the bellows 13 to supply suction to the suction cup member 15.

A solenoid 36 is mounted on housing side wall 3 (FIG. 2) and has an armature pin 37 which is biased outward when the solenoid is de-energized, to project the pin 37 to a position (shown crosshatched in FIG. 3 and in full lines in FIG. 3B) beneath a notch 38 formed in a corner of the bellows plate 21 adjacent the control boss 33 and cam follower roller 34. The pin 37 is thus projected when the picking mechanism is not functioning and the ATM does not call for notes to be picked from a note supply; that is to say, when the picker mechanism is in an at-rest or "home" position as shown in FIGS. 3, 3A and 3B. At the time when the pin 37 has been projected to engage in notch 38, the drive motor 9 stops, stopping further rotation of the cam 35 from approximately the position shown in FIG. 3.

When the parts are in this at-rest or "home" position, and the ATM is called upon to dispense notes, motor 9 and solenoid 36 are energized. The solenoid retracts armature pin 37 permitting spring 26 to rotate bellows plate 21 counterclockwise to engage cam follower roller 34 with cam 35. The motor, at the same time, rotates cam 35 clockwise and a note is withdrawn by suction cup member 15 through an access opening 39 in a container 40 having a note supply 41 in a stack therein, as described in said application Ser. No. 194,338.

The container 40, and access opening 39 are indicated in dot-dash lines in FIG. 3 but in full lines in FIGS. 7 through 11. The path of travel of the suction cup head 42 of the suction cup member 15 is shown in the diagrammatic illustration in FIG. 4 of such path of travel. This illustration is similar to the illustration of the suction head path of travel in said application Ser. No. 194,338.

The suction cup member 15 and related components, act as the primary picker device. One note is dispensed as called for during each revolution of the cam 35. The cam contour is such as to rotate the bellows plate 21 back and forth on its pivot shaft 20 to impart the necessary motion indicated in the FIG. 4 diagram, to the picker suction head 42 which is supplied with suction from the bellows 13 as the bellows 13 is expanded and contracted by motion of the bellows plate 21 connected at 23 with the bellows connector member 24.

The peripheral surface of cam 35 has a contour, as shown, with a major circular surface segment 43 (FIG. 7), one end of which is formed with a short slight recess 44, followed by a lobe 45 which in turn is followed by a deep extended recess 46 connected by a lobe 47 which merges into the other end of the circular segment 43. The peripheral cam surface thus varies in radial distance from its axis of rotation in the zones described.

The bellows plate 21 has a large recess 48, generally wedge shaped, extending from its edge 49 and above the notch 38 toward the bellows plate edge 50. This recess 48 provides a space where a latch mechanism, to be described, is located; the latch mechanism controlling engagement and disengagement of the primary and secondary picker devices.

The lever 18 which links suction cup member 15 to the fixed bellows plate pivot shaft 20 (FIG. 3B) has a pin 51 to which a spring 52 is connected. The other end of the spring 52 is secured at 53 to a crosspiece 54 of a U-shaped bracket 55 mounted on the closure wall 5 of the picker housing 2 (FIGS. 2 and 3B). Spring 52 biases lever 18 clockwise on pivot shaft 20 tending to pull such cup member 15 downward (FIG. 3B). Such downward movement of member 15, however, is restrained by contact of cam follower nose 56 on the major circular surface segment 43 of cam 35 (FIGS. 3, 3A and 3B).

Figure 5:
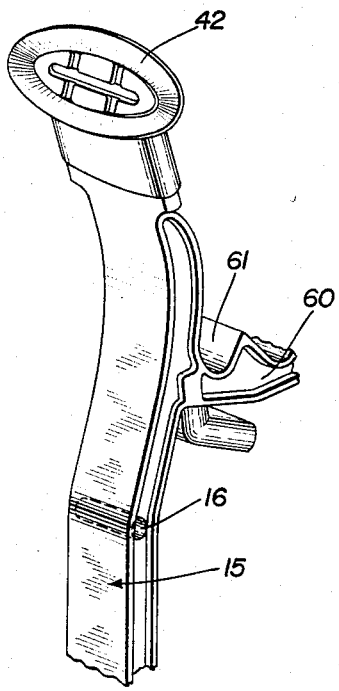
FIG. 5 is a fragmentary perspective view of a portion of the primary suction cup picker member.

A spaced pair of L-shaped brackets 57 are fixed to a shaft 58 which extends between picker housing side walls 3 and 4. A latch member 59 is mounted on and extends between the lower ends of L-shaped brackets 57. A hook member 60 is formed on and projects upward with respect to the upper end portion of member 15. An upwardly open socket 61 is formed by said hook member 60 as well shown in FIGS. 5 and 8.

The L-shaped brackets 57 straddle the hook member 60 and the latch member 59 is seated and held seated in the socket 61 (FIGS. 3 and 3B) when the member 15 is held upward by engagement of the cam follower nose 56 on lever 18 with the cam circular segment 43.

This latching of the member 15, in the position shown in FIGS. 3 and 3B, restrains movement of the suction cup head 42 toward the note supply stack 41. The suction cup head 42, unless restrained, is urged to move toward the note supply 41 by counterclockwise movement on pivotal connection 16 biased by tension spring 62 connected to member 15 below pivot point 16 and to a projection 63 on lever 18 (FIG. 3A).

Figure 6:
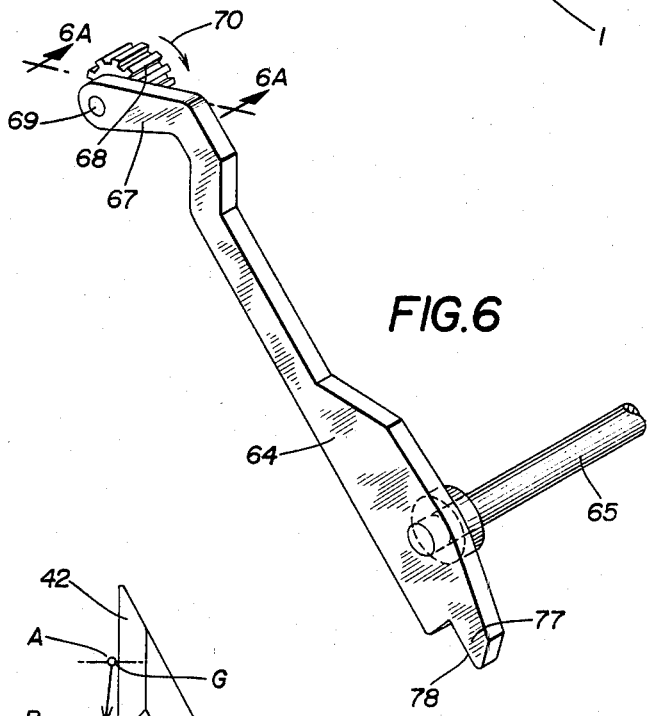
FIG. 6 is a fragmentary perspective view of a portion of the secondary picker member having a roll which frictionally engages a note when the primary and secondary picker members are engaged or locked together for operation in unison.

The secondary picker device includes a pair of lever arms 64 (FIGS. 2 and 6) the lower ends of which are fixed to a lever pivot shaft 65 in U-shaped fashion; and the pivot shaft 65 is journaled within a tubular member 66 mounted on and extending laterally from the surface of bellows plate member 21 facing the suction cup member 15 which is straddled by the U-shaped or bifurcated arrangement of the arms 64 (FIG. 2).

The upper end of each arm 64 is formed with an angular probe 67. A molded roller type rubber wheel or tire 68, with a serrated or grooved circumferential surface is journaled on a shaft 69 at the end of probe 67. The tire 68 is mounted on a oneway clutch 71 which intervenes the tire and shaft 69 to allow rotation of the tire in one direction, clockwise as shown by the arrow 70 in FIG. 6, and to prevent counterclockwise rotation of the tire. The friction characteristics of the circumferential surface of the tire 68 and the serrations of grooves therein provide a very effective means of gripping a paper money note as the tire, when locked against rotation by the one-way clutch 71, engages the note and moves in a direction wherein the locked status of the tire prevents the tire from rolling on the note.

The tire 68 has been indicated as being formed of molded rubber. The rubber formulation has high-friction characteristics and these characteristics are enhanced by the serrated or grooved surface of the tire. The one-way clutch 71 preferably is a product of Torrington Co.-Bearing Division, Torrington, Conn., identified by Torrington Product Number DF 53460.

Figure 7:
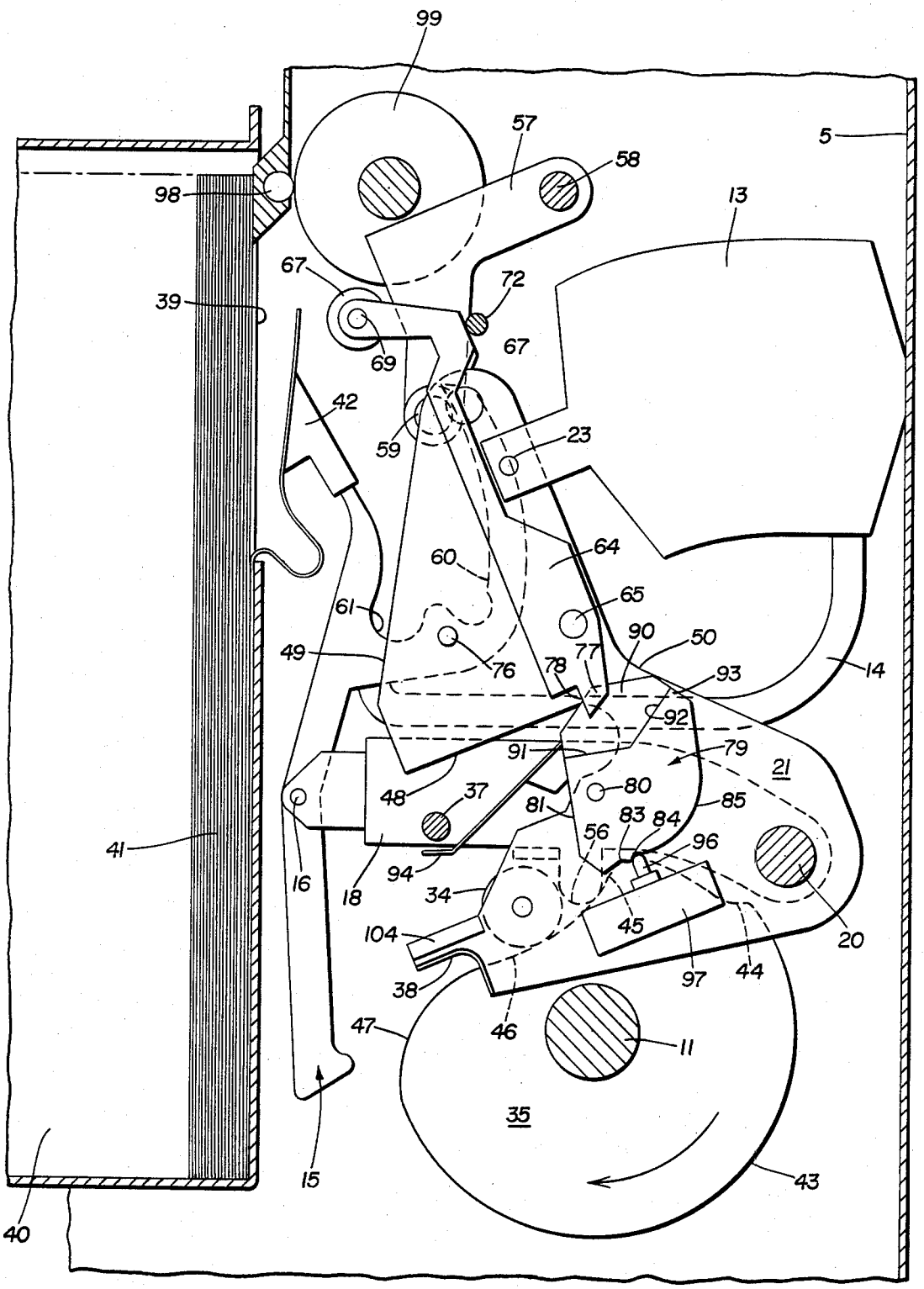
FIG. 7 is a diagrammatic view showing the position of certain of the picker mechanism components at a time when a solenoid controlled pin is actuated to cause the primary and secondary picker members to be locked together for operation in unison.

A pin 72 is mounted on and projects from housing side wall 3 (FIG. 2) across the path of movement of one of the arms 64 of the bifurcated arm assembly and stops rotative assembly movement clockwise, (viewing FIG. 7). The arm assembly is biased to move toward the pin 72 by spring 73 (FIGS. 2 and 3B) connected at one end to an arm 64 at 74 and at the other end to a bracket 75 mounted on the housing closure wall 5.

Figure 8:
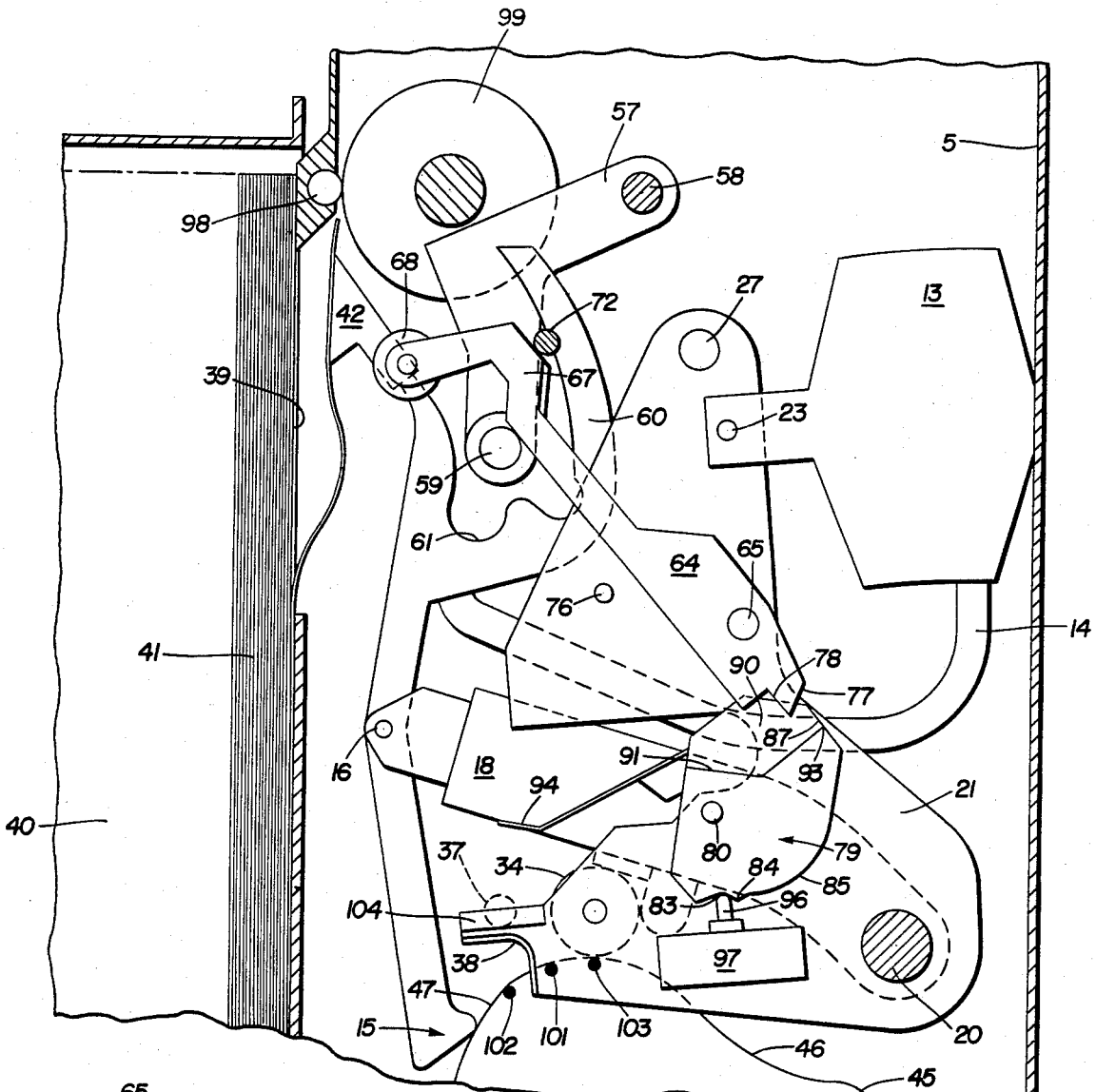
FIG. 8 is a diagrammatic view similar to FIG. 7 of the parts shown in FIG. 7 after a further small degree of clockwise rotation of the actuating cam.
Figure 9:
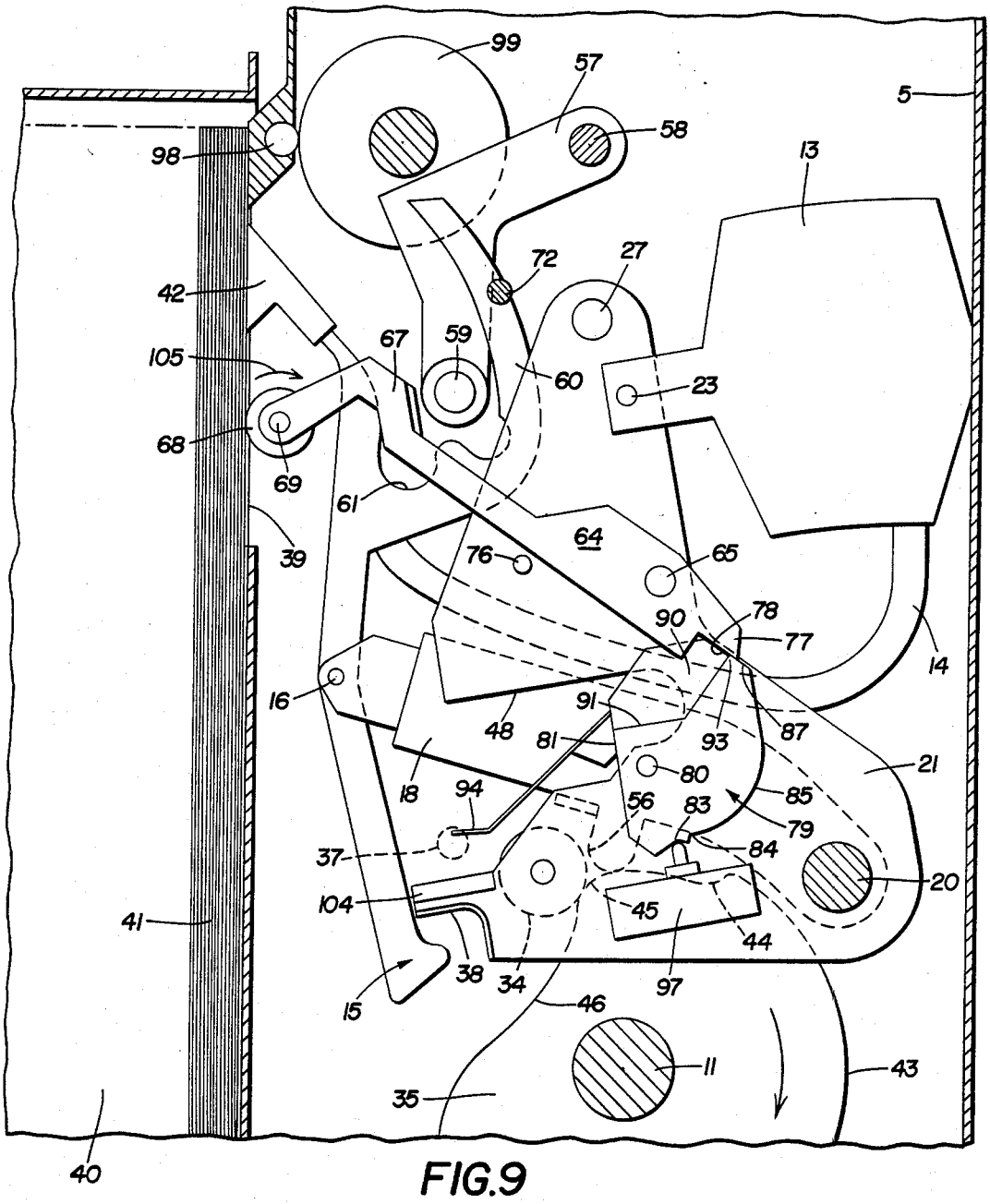
FIG. 9 is another diagrammatic view similar to FIGS. 7 and 8 showing the parts of the mechanism in their relative positions after the control cam has rotated through nearly one revolution from the position of the parts shown in FIG. 7, wherein the primary and secondary picker members are locked together and the secondary picker member has commenced to move through its cycle of operation to perform a picking function assisting the operation of the primary picker member.
Figures 1, 8:
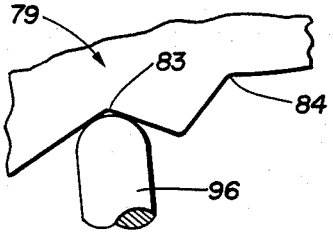
Figures 1, 8A:
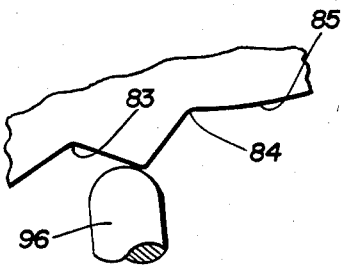
Figures 1, 8B:
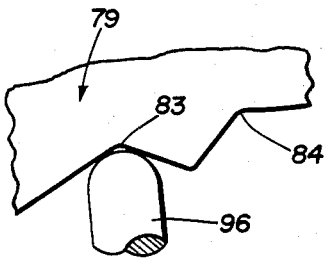
Figure 10:
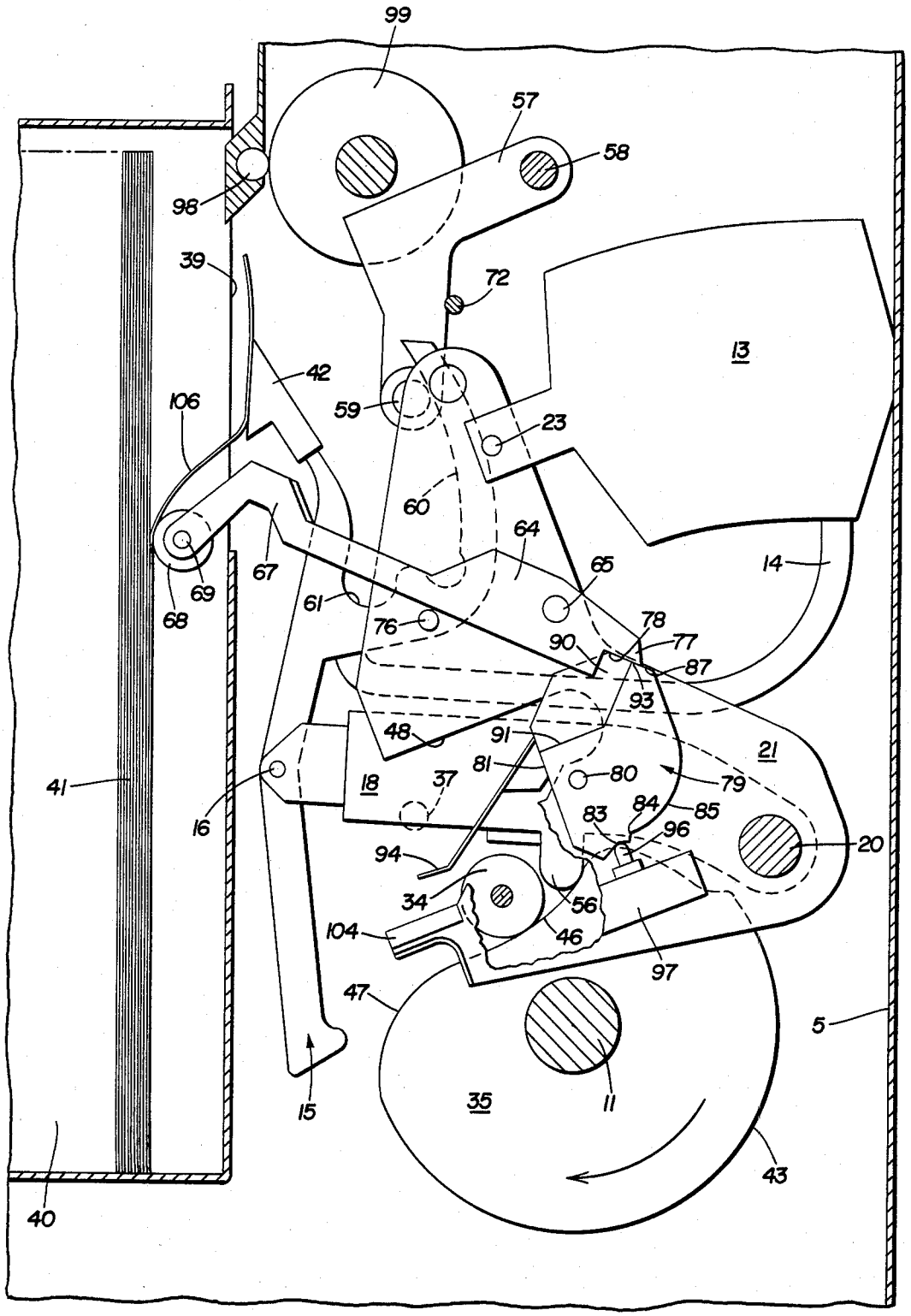
FIG. 10 is a view similar to FIGS. 7, 8 and 9 illustrating the parts after further clockwise rotation of the control cam from the position of FIG. 9, and illustrating the secondary picker member pushing against a stack of new paper money notes and moving them away from a sealed container access opening to peel the exposed note of the stack from other notes beneath.
Figure 11:
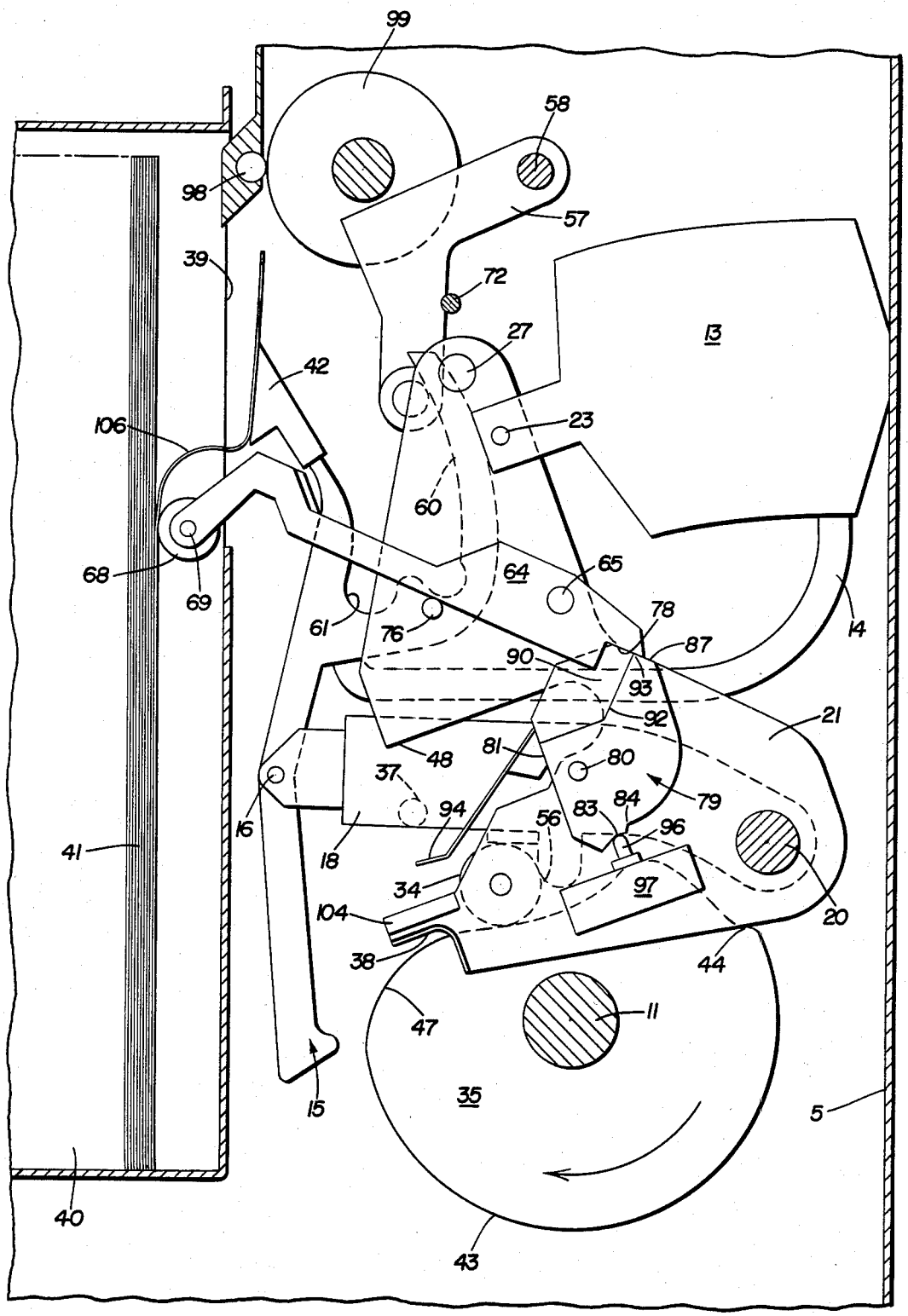
FIG. 11 is a view similar to FIGS. 7-10 showing further revolution of the control cam, and showing picker mechanism movement wherein the secondary picker member frictionally engages the note being picked to slide the engaged note upward along and relative to the stack, thus assisting the primary picker member in feeding the note to note conveyor mechanism.

When the arm assembly 64 is rotated to a position shown in FIGS. 9, 10 and 11 against the tension of spring 73 by other means to be described, its movement is limited by another pin 76 which is mounted on and projects from bellows plate 21. The tire 68, mounted on the probes 67 at the top of each arm assembly of arms 64, face each other or are mounted on shafts 69 which project toward one another as best shown in FIG. 2. At least one of the arms 64, preferably the right-hand arm of the arm assembly at the right of FIG. 2, has a latch finger 77 forming a latch recess 78 at the lower end of the arm below the pivot shaft 65 as best shown in FIGS. 7 through 11, the purpose of which is described below in connection with the description of the latch plate generally indicated at 79 and its function and operation.

The construction of the latch plate 79 is best shown in FIGS. 7A, 7B, 8A and 8B as well as in FIGS. 2, 3 and 7. Latch plate 79 is pivotally mounted at 80 on the bellows plate 21. Viewing FIGS. 7 and 7A, the latch plate has an irregular contour with a vertical edge 81 at the left, a lower edge with an angular corner 82 and two notches 83 and 84. Notch 84 extends to an upwardly curved surface 85 terminating in a vertical edge 86. The top edge of plate 79 has a truncated pyramid cross-sectional shape formed by angular surface 87 and top edge surface 88 and an angular surface 89 which connects with the upper end of vertical edge 81.

The major portion of latch plate 79 has a thickness substantially twice the thickness of the arms 64 with the latch finger and latch recess 77–78 at the lower end thereof with which the latch plate cooperates. The upper portion of latch plate 79 is cut away to have a reduced thickness at 90 provided by the recessed edge formed by edge portions 91 and 92 which extend angularly from one another, edge portion 92 being perpendicular to angular upper edge 87. Thus, a square cornered latch detent 93 is formed between angular edges 92 and 87 extending from the surface of the reduced thickness portion 90 of the latch plate 79.

The portion of the latch plate 79 cut away above edges 91 and 92 to form the reduced thickness portion 90 provides a recess in which the latch finger and recessed end 77–78 of arm 64 may overlap the latch plate reduced thickness portion 90 when the arm assembly 64 and latch plate 79 are pivotally mounted on the bellows plate 21.

A latch plate actuator strip 94, preferably somewhat springy, is mounted on a boss 95 extending rearwardly from the back side of the reduced thickness portion 90 of the latch plate. The mounting of the actuator strip 94 in this manner locates the strip within the large recess 48 in the bellows plate 21 in a manner in which the strip 94 can freely move within the recess to pivot the latch plate 79 relative to the bellows plate 21 for purposes to be described.

A spring-pressed latch plate control plunger 96, carried by box 97, is mounted on bellows plate 21 below the latch plate. Plunger 96 is engageable selectively with one or the other of the notches 83 and 84 on the lower edge of the latch plate 79.

Figure 4:
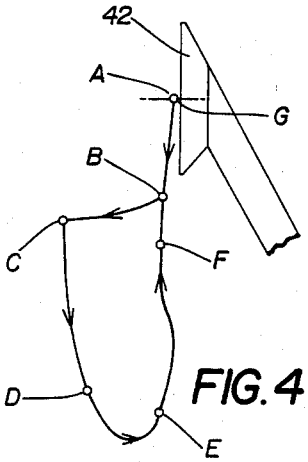
FIG. 4 is a diagrammatic illustration of the path of movement of the primary suction cup picker head member from the beginning to the end of a note picking operation.
Figure 6A:
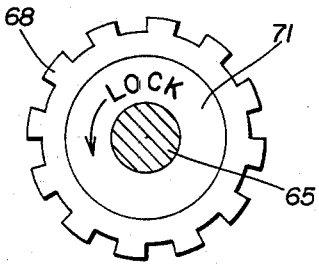
FIG. 6A is an enlarged sectional view through the secondary picker device rubber tire, looking in the direction of the arrows 6A—6A, FIG. 6.

A usual operation of picking a note from a note container access opening 39 with only the suction cup member 15 acting as a primary picker device proceeds as described below wherein the path of movement of the suction cup head 42 is illustrated in FIG. 4 and similarly in said application Ser. No. 194,338.

The suction cup head 42 is normally at rest at position A (FIG. 4) and as shown in FIG. 3. When a picking operation is called for, the head 42 moves downward from position A to position B while retained against movement toward a note supply stack by the interengagement of latch member 59 with the upwardly open socket 61. Movement also is imparted through the linkage system or lever 18 and cup member 15, and the operation of cam 35 and cam follower roller 34 on bellows plate 21 as well as the cam follower nose 56 on lever 18.

The head 42 then moves generally normal to the plane of the note exposed through access opening 39 from point B to point C. At point C the cup head 42 engages with suction an upper end portion of an exposed note. Cup movement then proceeds in a downward direction from point C to point D generally parallel with the plane of the exposed note in the note supply stack 41. During this movement the suction cup head 42 presses against the note stack and peels or drags an engaged note end downward relative to the access opening 39.

The head 42 then moves from point D to point E. This combines motion laterally away from the stack of notes in a direction normal to the stack, and the start of motion upwardly, in a direction opposite that of head 42 movement from point C to point D. The head 42 continues to move upward from point E to point F, the location of the head 42 at point F being generally shown in FIG. 8.

Head 42 then completes its cycle of movement from point F to point G which coincides with point A where the upper end of the note is engaged between conveyor rolls 98 and 99. The conveyor rolls and other conveyor means such as indicated at 100 in FIG. 1 then deliver the note to a dispenser station.

The note picking operation thus described immediately above performed by the primary picker device is an operation carried out in accordance with the disclosure of said application Ser. No. 194,338 and also as contemplated by the invention when picking notes from a supply stack of used or circulated paper money notes. During the described note picking operation, the bellows plate 21 moves toward and away from the note supply stack 41 on its pivot shaft 20 in accordance with movement of its cam follower roller 34 actuated by rotation of drive cam 35.

Frequently, when picking notes from a stack of circulated paper money notes, notes are encountered which are worn, quite old, limp, etc. and a picking failure occurs. In accordance with the invention, when such failure is sensed by means to be described, the programmed operation of the picking mechanism delivers a signal which de-energizes the solenoid 36 (which has been energized during the normal picking operation) thereby releasing or dropping its armature pin at the position of the parts shown in FIG. 7, that is, at the position shown of the cam 35 and latch plate actuator strip 94. The solenoid pin 37 at this time is located at the position illustrated by a cross-hatched circle above the end of actuator strip 94 in FIG. 7.

As the cam 35 continues to rotate some 30 to 50 degrees from the position shown in FIG. 7 to that of FIG. 8, the bellows plate 21 rotates clockwise on its pivot shaft 20 to the position shown in FIG. 8 carrying with it the latch plate 79. As the latch plate moves upward, the end of springy strip member 94 carried by the latch plate 79, wipes or sweeps across the end of solenoid armature pin 37 (FIG. 2). During the such wiping interaction, between the end of strip member 94 and spring-biased solenoid pin 37, the pin 37 moves strip member 94 to rotate latch plate 79 a slight distance counterclockwise on its pivot mounting 80 to reset the latch plate 79 to its arm 64 locking position shown in FIG. 8. The spring-pressed plunger 96, which controls the locking or unlocking positions of the latch plate 79, is reset from engagement with notch 84 in FIG. 7 to locking position notch 83 in FIG. 8. The parts with the latch plate thus reset are now in a position so that the latch plate 79 will lock the arms 64 in an operative position during further cam 35 rotation described below.

Meanwhile, the suction head 42 is in the position shown in FIG. 8 and the arms 64 are also in the position of FIG. 8 held against pin 72 by spring 73 (FIG. 3B).

During continued rotation of cam 35 from the position of FIG. 8, cam follower roller 34 rides along cam lobe 47 which curves to circumferential segment 43 (having a maximum diameter). Points 101 and 102 on cam lobe 47 are located at increasing radial distances away from the center of the cam shaft 11 and also greater distances than the distance that point 103 is radially spaced from cam shaft 11, point 103 being the point of contact of cam follower roller 34 with the cam lobe 47 in FIG. 8.

Figure 8A:
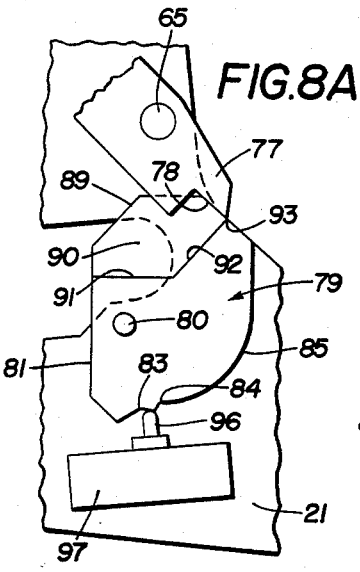
FIG. 8A is a fragmentary view of certain portions of certain parts in FIG. 8 showing their changed relative position after slight continued clockwise rotation of the control cam from the position in FIG. 8.

As roller 34 rides from point 103 to point 101, bellows plate 21 is raised and arms 64 held by pin 72 rotate counterclockwise slightly relative to their pivot shaft 65 on plate 21 to relocate the arm catch finger 77 to the position shown in FIG. 8A. The square corner latch detent 93 is also relocated slightly as the corner 93 rides along the outer surface of finger 77 to move latch plate 79 slightly, so that plunger 96 tends to try to ride out of lock notch 83. As roller 34 continues to ride along cam lobe 47 to point 102, the various parts assume the position shown in FIG. 8B wherein the detent 93 engages in latch recess 78 at the lower end of arm 64 locking the arm assembly 64 in operative position.

Figure 8B:
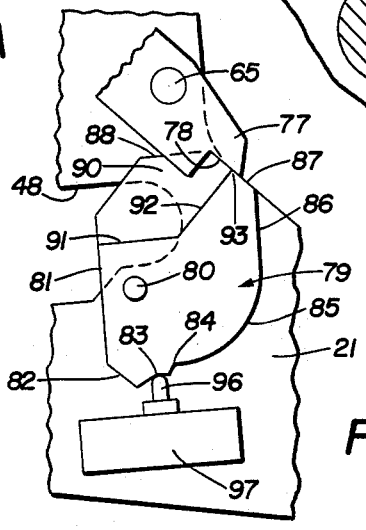
FIG. 8B is a view similar to FIG. 8A showing the changed position of the parts after a slight further rotation of the control cam from the cam positions of FIGS. 8 and 8A.

The slight movement of the latch plate 79 and the relative positions of the notches 83 and 84 and the plunger 96 in FIGS. 8, 8A and 8B are shown, respectively, in the larger diagrams of FIGS. 8-1, 8A-1 and 8B-1.

As bellows plate 21 raises during movement of roller 34 on lobe 47 from point 103 to point 102 and beyond, the upper wedge surface 104 of the projection forming the notch 38 in bellows plate 21 rides across the rounded end of solenoid outward biased armature pin 37 (FIG. 1). The location of pin 37 is indicated in dotted lines in FIG. 8. During revolution of the cam 35, from the position of FIG. 8 to the position of FIG. 9, the solenoid 36 is energized, retracting its armature pin 37. The relative position of pin 37 with respect to the remaining parts also is shown in dotted lines in FIG. 9.

The arm assembly 64 having been locked to the latch plate 79 and thus to the bellows plate 21 in operative position during initial movement of the cam 35 from the position of FIG. 8 to that of FIG. 9, as described in connection with FIGS. 8, 8A and 8B, said assembly 64 moves downward and its tires 68 engage a note exposed at container access opening 39 and start to roll downward thereon as shown in FIG. 9. The one-way clutch 71 permits the tire 68 to rotate in the direction of the arrow 105 shown in FIG. 9 as the tire moves down parallel with the surface of the exposed note.

As cam rotation continues from the position of FIG. 9 to that of FIG. 10, the arm assembly 64 presses inward into the container 40 through the access opening 39, and continues to roll downward along the exposed paper money note 106. Meanwhile, the suction head 42 suction-engages the note 106 above the tire 68 and arm assembly 64, as shown in FIG. 10, if the condition of the note 106 permits such suction-engagement following the picking failure that caused the arm assembly 64, as a secondary picker device, to be locked to and cooperate with the primary picker device (suction cup member 15 and related components).

As cam 35 continues to rotate from the position of FIG. 10 to the position of FIG. 11, the angular probes 67 on the ends of arms 64 start to move upward but the one-way clutches 71, on which the tires 68 are mounted, lock the tires against rotation and the tires frictionally engage the note 106 and pull it upward relative to the note supply stack 41 thus assisting the primary picker suction head 42 in picking the note 106 from the note supply 41.

Briefly summarizing the described operation of the secondary picker assembly 64 during a revolution of the drive cam 35, the bellows plate 21 with the pivot shaft 65 of assembly 64 locked thereto initially moves toward the note supply stack 41 as does the rubber tired roller 68. Roller 68 moves through the access opening 39 into the container 40 and presses against the stack pressure (FIG. 9) and then moves along the stack in one direction pressed against a note to be picked (FIG. 10). Subsequently, movement of the bellows plate 21 away from the stack moves the roller 68, frictionally engaged with the note to be picked against the stack pressure, in the other direction along the stack (FIG. 11) to strip the note from the stack and to move the note out of the container 40 through the access opening 39 as the roller 68 moves away from the stack back to the position of FIG. 8.

The picking mechanism of the invention utilizing combined operation of the primary and secondary picker devices 42–68 continues to pick notes from the stack when called upon to dispense notes so long as the latch mechanism maintains the arm assembly 64 locked to the latch plate 79.

Actually, when a picking operation is performed, the cam shaft 11 and cam 35 are rotating very rapidly so that the secondary rubber tired picker device 68 thrusts, pounds or thumps into and out of the container toward and away from the stack of notes equally rapidly which repeated thumping of the exposed note on the stack continues to facilitate picking and to aid the suction head 42 to act in the intended manner.

Figure 12:
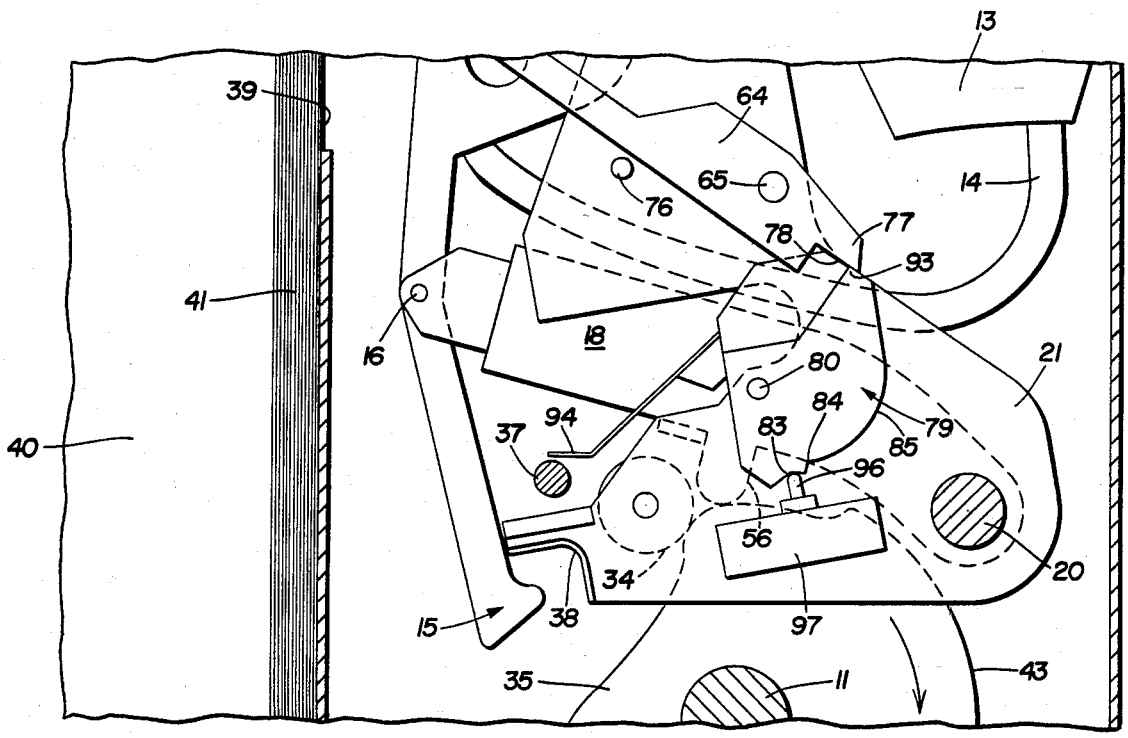
FIGS. 12, 13 and 14 are views showing operation of the solenoid controlled pin to release the locked status of the primary and secondary picker members thereby rendering the secondary picker member turned off or inoperative.

As picking operations continue with respect to a stack of circulated paper money notes in accordance with the above description wherein a picking failure initiated locking the secondary picker device to the primary picker device, if a picking failure again occurs, unlocking or disengagement or disabling of the secondary picker device arm assembly 64 is initiated. The picking failure is sensed and the programmed operation of the picking mechanism delivers a signal which again de-energizes the solenoid 36 thereby releasing or dropping its armature pin at the position of the parts shown in FIG. 12 where the pin is illustrated by a cross-hatched circle just below the end of actuator strip 94, the arm assembly 64 still being locked to latch plate 79.

As the cam 35 continues to rotate to the position of FIG. 13, the pin 37 engaging actuator strip 94 from below causes latch plate 79 to rotate clockwise on the bellows plate 21 disengaging the arm assembly 64 and releasing the arm assembly to return to stop pin 72 biased by spring 73 (FIG. 3B).

The secondary picker device arm assembly 64, and its friction tires 68 being disabled, permits picking to proceed with only the primary suction head 42 operative.

Figure 13:
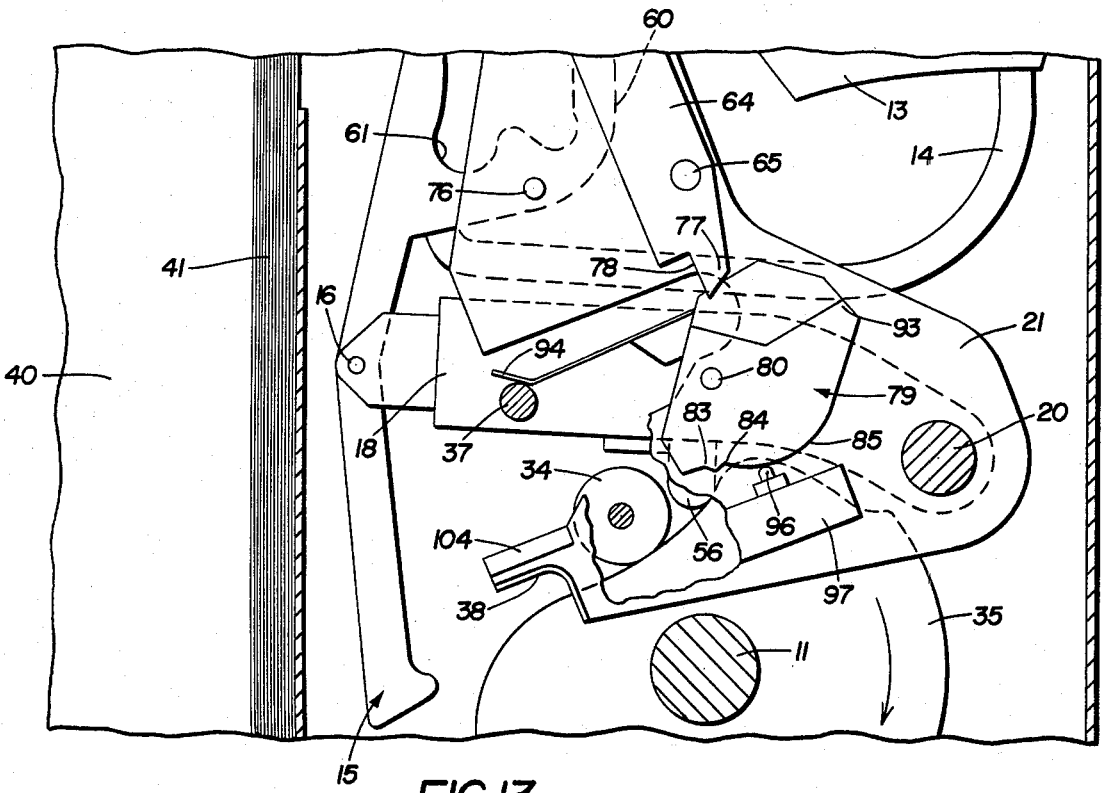
Figure 14:
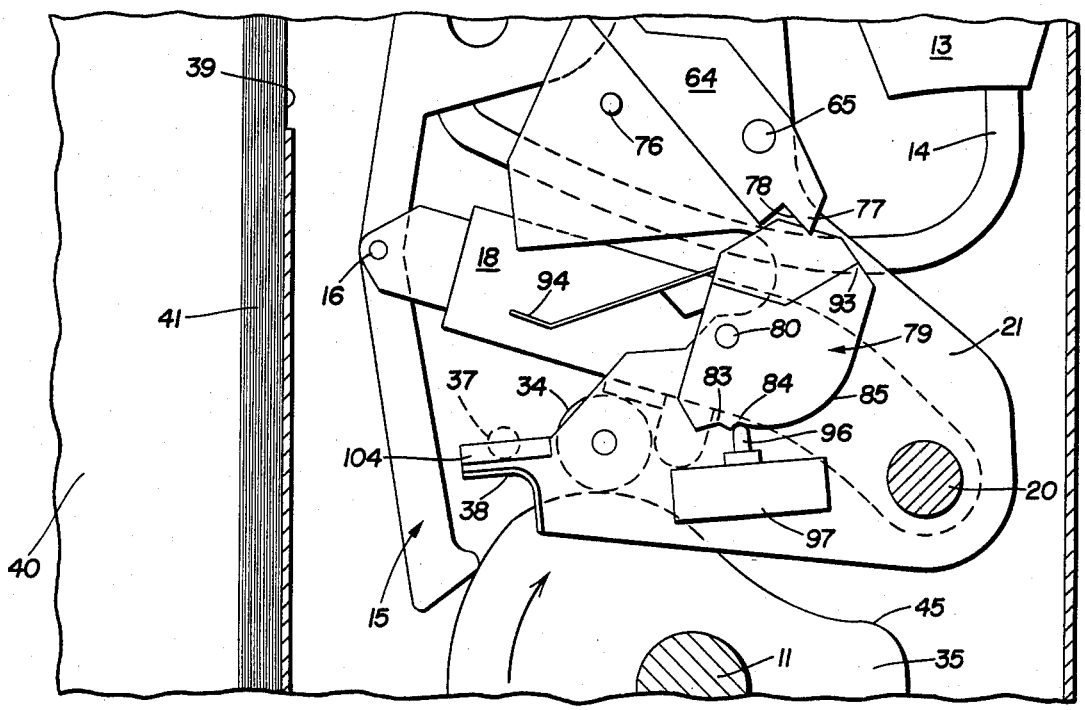

In FIG. 13, as the actuator strip 94 is moved by the armature pin 37, the latch plate is moved considerably past the off-position of the latch plate so that the plunger 96 rides along the up-curved surface 85 of the latch plate. At this time the solenoid 36 again is energized to retract the pin 37 which permits the latch plate 79 to move back to its off-position with the plunger 96 seated in the off-notch 94 as shown in FIG. 14 where the latch plate has sprung back to the normal unlatched position.

CONTROL SYSTEM FOR AUTOMATIC BANKING MACHINE MULTI-PICKER MECHANISM

For convenience in describing the control system for the operation of the primary-secondary picker mechanism which picks notes or bills from a supply stack thereof to be dispensed by an ATM, the arm assembly 64, its rubber tires 68 mounted on one-way clutches 71, its mounting on the bellows plate 21 and its related latch mechanism 78–93 are termed a "switchable thumper", the thumper, or secondary picker device, is associated with the suction cup member 15 or primary picker device which has the suction head 42. The thumper is switched between engagement with or disengagement from the suction member 15 whenever a picking failure occurs.

In a first mode of operation, the thumper is locked to the suction member 15 to act in unison in picking bills. In this mode the thumper is said to be "on". In a second mode of operation, the thumper is disengaged from the suction member 15 and is said to be "off". Accordingly, the thumper is referred to as a switchable thumper because it is switched from "on" to "off", or from "off" to "on", depending upon the particular mode of operation whenever a picking failure occurs during such operation.

Figure 15:
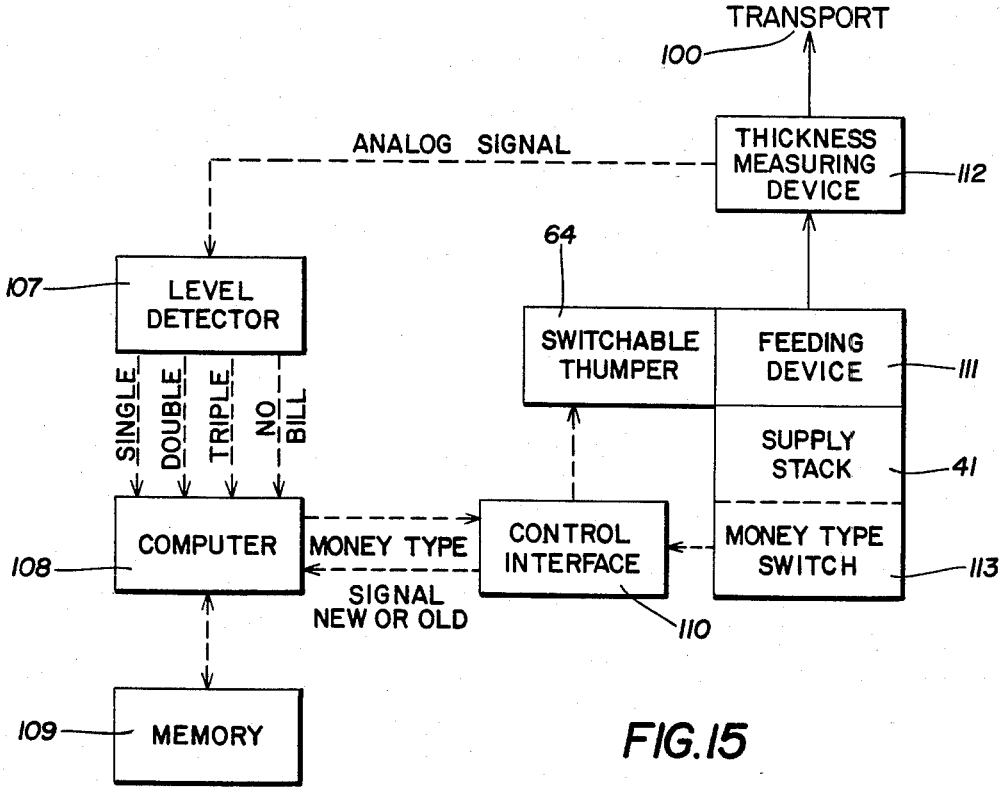
FIG. 15 is a block diagram illustrating a note status detector or sensor in the control system for operation of an automatic banking machine in which the multi-picker mechanism of the invention is utilized.

The basic control system block diagram of FIG. 15 is a modification of the block diagram of the ATM bill-dispensing equipment having a bill status detector illustrated in FIG. 1 of copending Graef et al. application Ser. No. 309,022. The modification involves adding the switchable thumper 64 to the diagram, adding a "no bill" signal from the level detector 107 to the computer 108, and adding a "money type" signal from the money type switch 113 to the computer 108.

The system of said application Ser. No. 309,022 is used for detecting bill status, etc. in the operation of the ATM cash dispensers 1 provided with the switchable thumper. The disclosure of said application Ser. No. 309,022 is incorporated herein by reference in its entirety.

The main intelligence device of the control system is the computer 108 which preferably is a conventional microprocessor (MP) responsive to programming and data stored in memory 109. Computer 108, which may be the same computer as used in the Graef application, supra, transmits control information to the control interface 110 and receives data of single bills, double bills and triple bills from the level detector 107 as well as "no bill" data. It also receives data of what type of money the supply stack contains, old bills or new bills, from the money type switch 113 which is integral with the supply cassette. This switch is set by personnel loading the supply cassette. The level detector 107 measures the thickness of the bill and classifies it as a single bill, double bill, triple bill, or no bill. The control interface 110 cooperates to actuate the switchable thumper 64. The switchable thumper 64 is an integral part of the feeding device 111 which picks bills. The supply stack of bills 41 is another integral part of the feeding device 111. The feeding device checks bills which are measured at the thickness measuring device station 112 before the bills go on to the conveyor system transport 100. The thickness measuring device 112 sends an analog signal which has voltage proportional to the bill thickness to the level detector 107. The level detector examines the analog signal and determines whether it is "no bill", single bill, double bill, or triple bill.

If the level detector 107 indicates "no bill" passing, the thumper is energized. The no bill information goes to the computer 108, the computer goes through the flow chart of decisions (FIG. 16), passes appropriate information to the control interface 110 to selectively engage or disengage the switchable thumper 64, that is, to establish an "on" or an "off" status of the switchable thumper 64.

The flow chart of FIG. 16 illustrates the routine for control of the switchable thumper during picking of old bills. Programming of the computer 108 to provide control in accordance with this routine is preferably provided by firmware stored in the memory 109 in a conventional manner. This type of programming is particularly useful in a microprocessor environment as preferred herein; other types of computers, such as larger general purpose, software programmed systems could be used, however. The start point is a command to pick a bill. The first matter checked at program step A is to determine if the solenoid 36 is off or de-energized. The solenoid controls the feeding of bills. Since there is a command to feed bills, and the solenoid is off, the first action is to pull the solenoid at step B; that is, to energize the solenoid 36 and retract the armature pin 37 and to activate feed, that is energize drive motor 9.

Next is a check at step C—if a document was not fed. If there has been a picking failure, the "yes" answer at step C indicates "no bill". Step D then questions, "Is the thumper already on?" If the answer at step D is "no", the thumper must be turned on and this is done at step E by dropping the solenoid pin 37 by de-energizing the solenoid 36 at the time shown in FIG. 7 that turns the thumper "on".

A bill is fed by the combined action of the thumper and suction head 42 and at step H the question is asked, "Has the desired number of documents been fed?" Assuming that the answer is "no", and that more bills are desired, returning to step A the routine is repeated until the desired number of bills has been fed.

The flow chart of FIG. 16 relates primarily to programming when old bills in a stack are being picked. It was necessary to switch the thumper "on" following a picking failure just described in order to correct conditions causing the picking failure. Once the thumper is turned "on" it will remain in this state until further action is taken. However, it has been found in picking old or circulated bills that the thumper should not be maintained "on" continuously after use to correct a picking failure.

Thus, in returning to step A to dispense additional bills, it is not intended that the thumper should remain "on" if a bill has been picked. The routine proceeds at step A with determining whether the solenoid is "off". The answer is "yes" and at step B the solenoid is energized and feed-activated again. Then at step C, assuming that a bill has been picked (because of correcting the cause of the picking failure) the answer is "no" and at step F the answer is "yes". Now, the thumper must be turned "off" and this is done at step G by dropping the solenoid pin 37 by de-energizing the solenoid 36 at the time shown in FIG. 12 that turns the thumper "off". At step H the question again is asked whether the desired number of documents has been fed. If not, the routine is repeated until the desired number of bills has passed and when this has been determined at step H, the action at step I is to drop or de-energize the solenoid at the time when the armature pin 37 will stop feeding or picking bills.

Basically, the same procedure is carried out in picking bills from a stack of new paper money bills, as described in connection with the old bill flow chart, FIG. 16. However, when picking new bills, the thumper is turned "off" when a picking failure occurs, and is turned "on" after the failure has been corrected.

Since picking failures occur repeatedly and frequently when picking new bills because of their sticking together in a stack which is held under pressure in a container, it is desirable to maintain the thumper "on" when the supply stack 41 is composed entirely of new money.

The foregoing description indicates that the thumper is selectively engaged and disengaged by intelligent control to pick bills which would otherwise cause failure in the use of prior art picker mechanism. Prior devices have no selective engagement or disengagement of a plurality of different picking devices which in one mode of operation act in unison but which cannot be used under all circumstances at all times with various kinds, types or conditions of paper money notes or bills.

One of the fundamental aspects of the invention is the switchable thumper. The thumping action of the thumper cannot be used continuously on old or circulated currency. However, during dispensing without the thumping motion, a bill may appear that cannot be picked. It is desired to turn the thumper on at this time to clear the stubborn bill, and then to turn the thumper off.

The switchable capability of turning the thumper on and off from one mode to the other renders the ATM more impervious to poor bill condition and improper loading of bills in the containers thereof installed in ATM's.

Accordingly, the new multi-picker mechanism and its construction and operation satisfy the stated objectives; overcome problems that have been encountered with the use of prior art picker mechanisms; enables bills, new or old, to be withdrawn one at a time from sealed, tamper-indicating containers having access openings without the machines being jammed due to a picking failure which could require servicing before proper operation of the ATM can be restored; and satisfy needs existing in the use of ATM's.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

We claim:

1. Multi-picker mechanism for picking notes one at a time from a note supply stack in an ATM housing, including a picker housing; primary picker means mounted in the picker housing; secondary picker means switchably engageable with or disengageable from the primary picker means mounted in the picker housing; means for operating the primary picker means to pick notes from a note supply stack; and means enabled by the occurrence of a picking failure selectively to engage or disengage the secondary picker means with or from the primary picker means to reestablish picking operations.

2. The construction defined in claim 1 in which the primary picker means includes suction cup means suction-engageable with an exposed note on the stack, in which the secondary picker means includes roller means frictionally engageable with said exposed note, and in which the suction cup means, and the roller means when operating, move toward and away form the stack combined with movement parallel with the surface of the exposed note during an operation of picking of an exposed note from the stack.

3. The construction defined in claim 2 in which the switchable picker roller means includes pivotally mounted arm assembly means, angular probe members at the end of the arm means, and rubber tires rotatably mounted on one-way clutches mounted on said probe members.

4. The construction defined in claim 2 in which each of the suction cup and roller means is pivotally associated with a plate pivotally mounted in the picker housing; in which a motor-driven cam is rotatably mounted on a cam shaft in the picker housing; in which the cam moves said plate back and forth on its pivotal mounting to impart movement to the suction cup and roller means toward and away from the stack combined with movement parallel with the surface of the exposed note during picking of an exposed note from the stack.

5. The construction defined in claim 4 in which the suction cup means includes pivotally connected lever members having one end of one lever pivotally mounted on a pivot shaft on which said plate is pivotally mounted; in which the switchable picker roller means is pivotally mounted on said plate; in which the cam has a peripheral actuating surface varying in radial distance from its axis of rotation in zones of said peripheral surface; and in which each of said plate and suction cup means has cam follower means engageable with said peripheral cam surface, whereby the suction cup and roller means are moved toward and away from the stack combined with movement parallel with the surface of the exposed note during picking of an exposed note from the stack.

6. The construction defined in claim 5 in which the primary picker means includes bellows means mounted in the picker housing; in which the bellows means has suction connection with said suction cup means; and in which the bellows means is connected with said plate to expand and collapse the bellows means during back and forth pivotal movement of said plate.

7. The construction defined in claim 1 in which the means for engaging or disengaging the secondary picker means with or from the primary picker means includes latch means to engage or disengage the secondary picker means with or from the primary picker means; and solenoid means for actuating said latch means to switch said secondary picker means between latched and unlatched status with respect to said primary picker means.

8. The construction defined in claim 7 in which the latch means has latch members mounted on each of the primary and secondary picker means; in which the latch members are relatively movable between engaged and disengaged positions; and in which the solenoid means is engageable with the latch member mounted on the primary picker means to move said latch member from engaged to disengaged position and vice versa.

9. The construction defined in claim 8 in which the primary picker means includes suction cup means suction-engageable with an exposed note on the stack; in which the primary picker means also includes bellows means mounted in the picker housing having suction connection with said suction cup means; in which the primary picker means also includes a plate pivotally mounted in the picker housing which is moved back and forth on its pivot mounting to impart picking motion to said primary and secondary picker means when operating to pick notes from a stack; and means connecting said bellows means and plate to expand and collapse the bellows means during pivotal movement of said plate.

10. The construction defined in claim 1 in which the means for engaging or disengaging the secondary picker means with or from the primary picker means includes latch means having latch members mounted on each of the primary and secondary picker means; and in which the latch members are relatively movable between engaged and disengaged positions.

11. The construction defined in claim 1 in which the means for engaging or disengaging the secondary picker means with or from the primary picker means includes latch means; in which the latch means includes a latch plate pivotally mounted on the primary picker means movable between latched-on and unlatched-off positions; spring-pressed latch plate control plunger means mounted on the primary picker means engageable with spaced notch means formed on the latch plate to selectively retain the latch plate in either latched-on or unlatched-off position; in which the latch plate is formed with a latch detent; in which the latch means includes a latch recess formed on the secondary picker means engageable with said latch detent to lock the primary and secondary picker means together when the latch plate is in engaged-on position; in which the latch plate is provided with an actuator arm to move the latch plate between engaged-on and disengaged-off positions; in which solenoid means is mounted in the picker housing having an armature pin which is projected when the solenoid is de-energized and in which the armature pin when projected engages the latch plate actuator arm when the latch plate is in either engaged-on or disengaged-off positions to reset the latch plate in the other position to switch the secondary picker means from engaged to disengaged status with respect to the primary picker means and vice versa.

12. The construction defined in claim 1 in which the secondary picker means includes an arm assembly pivotally connected with the primary picker means; in which the arm assembly has rubber tires mounted on one-way clutches carried by the arm assembly; in which during engaged operation of the primary and secondary picker means the tires roll in one direction along an exposed note and push against the note, and are held by the clutch against rotation during movement of the tires in a direction opposite said one direction to frictionally engage and pick said note from the stack.

13. The construction defined in claim 12 in which disengageable latch means is provided preventing rotational movement of the secondary picker means on its pivot connection with the primary picker means during engaged operation of the primary and secondary picker means.

14. Multi-picker mechanism for picking notes one at a time from a note supply stack in an ATM housing, including a primary picker member having a suction type picker cup; a secondary picker member having a rubber tired roll rotatable in one direction only adapted frictionally to engage a note; means for selectively engaging the primary and secondary members for operation in unison or for disengaging the secondary member from the primary member so that the primary member acts alone to pick notes; means for moving said picker members in various directions with respect to the note surface of a note being picked to grip the note surface, to distort its shape, and to dislodge, separate and pull such note from the stack of notes of which it forms a part; means for controlling the operation of said multi-picker mechanism to switch the mechanism from one of two operative modes to the other and vice versa, depending upon the type of notes being picked, when a picking failure occurs; and means actuated by said picker members moving means to supply suction to said picker cup.

15. Multi-picker mechanism for picking notes one at a time from a note supply stack in an ATM housing, including a picker housing; primary picker means mounted in the picker housing; secondary picker means switchably engageable with or disengageable from the primary picker means mounted in the picker housing; means for operating the primary picker means to pick notes from a note supply stack; and means enabled by the occurrence of a picking failure resulting from differing note conditions selectively to engage or disengage the secondary picker means with or from the primary picker means to reestablish picking operations.

16. Multi-picker mechanism for picking notes one at a time from a supply stack in an ATM housing of notes having variable age and limpness characteristics randomly arranged in the stack, including a picker housing; primary picker means mounted in the picker housing; secondary picker means switchably engageable with or disengageable from the primary picker means mounted in the picker housing; means for operating the primary picker means to pick notes from said note supply stack; and means enabled by the occurrence of a picking failure during operation of the primary picker means to engage the secondary picker means with the primary picker means to reestablish picking operations.

17. The construction defined in claim 16 in which said enabling means disengages the second picker means from the primary picker means when a picking operation has been reestablished.

18. Multi-picker mechanism for picking notes one at a time from a supply stack of new paper money notes in an ATM housing, including a picker housing; primary picker means mounted in the picker housing; secondary picker means switchably engageable with or disengageable from the primary picker means mounted in the picker housing; means for operating the primary and secondary picker means engaged together to pick notes from said note supply stack; and means enabled by the occurrence of a picking failure to disengage the secondary picker means from the primary picker means to reestablish picking operations.

19. The construction defined in claim 18 in which the enabling means reengages the secondary picker means with the primary picker means when a picking operation has been reestablished.

20. Multi-picker mechanism for picking notes one at a time from a note supply stack in an ATM housing, including a picker housing; primary and secondary picker means mounted in the picker housing; means for selectively operating said primary and secondary picker means either engaged or disengaged; and means enabled by the occurrence of a picking failure to switch the primary and secondary picker means, from disengaged to engaged status when operating disengaged, and from engaged to disengaged status when operating engaged, to reestablish picking operations.

21. Multi-picker mechanism for picking notes one at a time from a note supply stack in an ATM housing, including a picker housing; primary picker means mounted in the picker housing; secondary switchable picker means mounted in the picker housing; means for operating the primary and secondary picker means in a first mode locked together to pick notes from a note supply stack; means for unlocking the secondary picker means from the primary picker means to operate said primary picker means alone in a second mode to pick notes from said note supply stack; and means for switching said secondary picker means from one mode to the other when a picking failure occurs during operation in said one mode.

22. The construction defined in claim 21 in which the primary picker means includes suction cup means suction-engageable with an exposed note on the stack, in which the secondary picker means includes roller means frictionally engageable with said exposed note, and in which each of the suction cup and roller means is moved toward and away from the stack combined with movement parallel with the surface of the exposed note during picking of the exposed note from the stack when the picker mechanism operates in said first mode.

23. The construction defined in claim 22 in which the switchable picker roller means includes pivotally mounted arm assembly means, angular probe members at the end of the arm means, and rubber tires rotatably mounted on one-way clutches mounted on said probe members.

24. The construction defined in claim 22 in which each of the suction cup means and roller means is pivotally associated with a plate pivotally mounted in the picker housing; in which a motor-driven cam is rotatably mounted on a cam shaft in the picker housing; in which the cam moves said plate back and forth on its pivotal mounting to impart movement to the suction cup and roller means toward and away from the stack combined with movement parallel with the surface of the exposed note during picking of the exposed note from the stack.

25. The construction defined in claim 24 in which the suction cup means includes pivotally connected lever members having one end of one lever pivotally mounted on a pivot shaft on which said plate is pivotally mounted; in which the switchable picker roller means is pivotally mounted on said plate; in which the cam has a peripheral actuating surface varying in radial distance from its axis of rotation of zones of said peripheral surface; and in which each of said plate and suction cup means has cam follower means engageable with said peripheral cam surface, whereby the suction cup and roller means are moved toward and away from the stack combined with movement parallel with the surface of the exposed note during picking of the exposed note from the stack.

26. The construction defined in claim 25 in which the primary picker means includes bellows means mounted in the picker housing; in which the bellows means has suction connection with said suction cup means; and in which the bellows means is connected with said plate to expand and collapse the bellows means during back and forth pivotal movement of said plate.

27. The construction defined in claim 21 in which the means for switching said secondary picker means from one mode to the other includes latch means to engage or disengage the secondary picker means with the primary picker means; and solenoid means for actuating said latch means to switch said secondary picker means from one mode to the other.

28. The construction defined in claim 27 in which the latch means has latch members mounted on each of the primary and secondary picker means; in which the latch members are relatively movable between engaged and disengaged positions; and in which the solenoid means is engageable with the latch member mounted on the primary picker means to move said latch member from engaged to disengaged position and vice versa.

29. The construction defined in claim 28 in which the primary picker means includes suction cup means suction-engageable with an exposed note on the stack; in which the primary picker means also includes bellows means mounted in the picker housing having suction connection with said suction cup means; in which the primary picker means also includes a plate pivotally mounted in the picker housing which is moved back and forth on its pivot mounting to impart picking motion to said primary and secondary picker means when operating in said first mode and to said primary picker means when operating in said second mode and means connecting said bellows means and plate to expand and collapse the bellows means during pivotal movement of said plate.

30. The construction defined in claim 21 in which the means for switching said secondary picker means from one mode to the other includes latch means having latch members mounted on each of the primary and secondary picker means; and in which the latch members are relatively movable between engaged and disengaged positions.

31. The construction defined in claim 21 in which the means for switching said secondary picker means from one mode to the other includes latch means; in which the latch means includes a latch plate pivotally mounted on the primary picker means movable between latched-on and unlatched-off positions; spring-pressed latch plate control plunger means mounted on the primary picker means engageable with spaced notch means formed on the latch plate to selectively retain the latch plate in either latched-on or unlatched-off position; in which the latch plate is formed with a latch detent; in which the latch means includes a latch recess formed on the secondary picker means engageable with said latch detent to lock the primary and secondary picker means together when the latch plate is in engaged-on position; in which the latch plate is provided with an actuator arm to move the latch plate between engaged-on and disengaged-off positions; in which solenoid means is mounted in the picker housing having an armature pin which is projected when the solenoid is de-energized; and in which the armature pin when projected engages the latch plate actuator arm when the latch plate is in either engaged-on or disengaged-off positions to reset the latch plate in the other position to switch the secondary picker means from one mode to the other.

32. The construction defined in claim 21 in which the secondary picker means includes an arm assembly pivotally connected with the primary picker means; in which the arm assembly has rubber tires mounted on one-way clutches carried by the arm assembly; in which during first mode operation of the mechanism the tires roll in one direction along an exposed note and push against the note, and are held by the clutch against rotation during movement of the tires in a direction opposite said one direction to frictionally engage and pick said note from the stack.

33. The construction defined in claim 32 in which disengageable latch means is provided preventing rotational movement of the secondary picker means on its pivot connection with the primary picker means during first mode operation of the mechanism.

34. Multi-picker mechanism for picking notes one at a time from a note supply stack in an ATM housing, including a primary picker member having a suction type picker cup; a secondary picker member having a rubber tired roll rotatable in one direction only adapted frictionally to engage a note; means for selectively engaging the primary and secondary members for operation in unison or for disengaging the secondary member from the primary member so that the primary member acts alone to pick notes; means for moving said picker members in various directions with respect to the note surface of a note being picked to grip the note surface, to distort its shape, and to dislodge, separate and pull such note from the stack of notes of which it forms a part; and means for controlling the operation of said multi-picker mechanism to switch the mechanism from one of two operative modes to the other and vice versa, depending upon the type of notes being picked, when a picking failure occurs.

35. Picker mechanism for picking notes through an ATM note container access opening one at a time from a note stack held under pressure in said container, including, first suction picker means; second friction engageable picker means; lock means for said second picker means movable between locked and unlocked status, respectively to couple the second picker means to or to uncouple the second picker means from said first picker means; means actuated by a picking failure to move the lock means from locked to unlocked status and vice versa depending upon the status of the lock means when picking failure occurs; and means for actuating the first and second picker means and said lock means to pick notes from a note stack.

36. The construction defined in claim 35 in which notes may be picked from note stacks of notes selected from the class consisting of new or circulated notes; in which the first and second picker means are actuated with the lock means in locked status when picking notes from a note stack of new notes and in unlocked status when picking notes from a note stack of circulated notes; and in which the lock means status is switched from the status in which it is operating to the other automatically upon the occurrence of a picking failure.

37. The construction defined in claim 36 in which there is sensor means for sensing a picking failure; and in which when a picking failure is sensed the sensor means switches the lock means from its operating status to the other.

38. The construction defined in claim 35 in which the means for actuating the first and second picker means and the lock means includes, (a) a picker housing;

(b) bellows means mounted in the housing having suction connection with said first picker means;

(c) bellows plate means connected with the bellows means pivotally mounted for oscillation on a pivot shaft in said housing;

(d) means pivotally connecting the first picker means to said bellows plate pivot shaft;

(e) motor driven rotatable cam means operatively engaging the first picker means and the bellows plate means to oscillate said bellows plate means to and fro to expand and collapse said bellows means to supply suction to said first picker means, and to oscillate said first picker means toward and away from and along the note stack; and (f) means pivotally mounting the second picker means and the lock means at spaced locations on the bellows plate means;

and in which the means actuated by a picking failure includes, (g) a springy actuator strip mounted on the lock means; and (h) solenoid means mounted in the housing having armature pin means projected to engage said actuator strip when a picking failure occurs to change the status of the lock means;

whereby picking operations are reestablished.

39. In suction type picker mechanism for picking notes through an ATM note container access opening one at a time from a note stack in said container, note engageable friction picker means operative to dislodge notes from a note stack when a picking failure occurs; and means for moving the friction picker means toward and along the note to be picked to establish frictional engagement with said note, thereby to reestablish picking operations.

40. In a picker mechanism for picking notes from an ATM note container access opening one at a time from a note stack held under pressure in said container; note engageable friction picker means including a lever arm, a lever pivot shaft, one end of the lever arm being fixed to said pivot shaft; a plate; means mounting the plate for movement toward and away from said stack; rubber tired roller means rotatably mounted on one-way clutch means on the other end of said lever arm; means pivotally mounting the pivot shaft on the plate; releasable means for locking the lever arm and pivot shaft against pivotal movement on the plate; and means for moving the plate toward and away from said stack; whereby movement of the plate, when the lever pivot shaft is locked against pivotal movement on the plate, toward said stack moves said pivot shaft toward said stack and moves the rubber tired roller means toward and through said access opening into the container to press said roller against the stack pressure, and then moves the roller means along the stack in one direction along a note to be picked; and whereby subsequent movement of the plate away from said stack moves the roller means, frictionally engaged against the stack pressure with said note to be picked, in the other direction along the stack to strip said note from the stack and to move said note out of the container through the access opening as the roller means moves away from the stack.

* * * * *